US005121572A

United States Patent [19]

Hilscher

[11] Patent Number: 5,121,572

[45] Date of Patent: Jun. 16, 1992

[54] OPPOSED DISC DEBURRING SYSTEM

[75] Inventor: Jerome A. Hilscher, Olathe, Kans.

[73] Assignee: Timesavers, Inc., Minneapolis, Minn.

[21] Appl. No.: 783,396

[22] Filed: Oct. 28, 1991

Related U.S. Application Data

[63] Continuation of Ser. No. 619,753, Nov. 6, 1990, abandoned.

[51] Int. Cl.[5] ..... B24B 7/04

[52] U.S. Cl. ..... 51/111 R; 51/118; 51/131.2; 51/131.3

[58] Field of Search ..... 51/111 R, 117, 118, 51/129, 131.1, 131.2, 131.3

[56] References Cited

U.S. PATENT DOCUMENTS

| | | | |
|---|---|---|---|
| 766,403 | 8/1909 | Vincke | 51/118 |
| 1,527,808 | 2/1925 | McIntyre | 51/133 |
| 1,599,374 | 9/1926 | Skillings | 51/131.3 |
| 2,089,040 | 8/1937 | Shue | 51/111 R |
| 2,990,659 | 7/1961 | Benkovich et al. | 51/118 |
| 3,142,137 | 7/1964 | Fallon et al. | 51/111 R |
| 3,382,622 | 5/1968 | Dunn | 51/115 |
| 3,541,734 | 11/1970 | Clar | 51/111 R |
| 3,774,348 | 11/1973 | Dunn | 51/111 R |
| 3,888,050 | 6/1975 | Elm | 51/135 R |
| 3,889,428 | 6/1975 | Steinegger et al. | 51/112 |
| 4,422,265 | 12/1983 | Branston | 51/52 R |
| 4,531,327 | 7/1985 | Dzewaltowski et al. | 51/103 WH |
| 4,617,767 | 10/1986 | Ali | 51/358 |
| 5,016,399 | 5/1991 | Vinson | 51/118 |

*Primary Examiner*—Bruce M. Kisliuk
*Assistant Examiner*—E. Morgan
*Attorney, Agent, or Firm*—Haugen and Nikolai

[57] ABSTRACT

An opposed double-disc abrasive deburring apparatus designed for simultaneous deburring of both major surfaces of workpieces. The abrasive material is carried in opposed double-disc counter-rotating abrasive media retaining pads, with the workpieces being carried through the pads on a turntable having workpiece receiving and guiding bores formed therein.

4 Claims, 3 Drawing Sheets

OPPOSED DISC DEBURRING SYSTEM

BACKGROUND OF THE INVENTION

The present invention relates generally to an improved opposed double-disc abrasive deburring apparatus, and more particularly to a double-disc abrasive surface treatment apparatus particularly designed for deburring workpiece surfaces including the simultaneous deburring of both major surfaces of workpieces being treated. More specifically, the present invention relates to an improved opposed double-disc abrasive workpiece surface treating apparatus which employs a turntable with workpiece receiving and guiding bores formed therein designed to carry the workpieces along a plane extending generally between the forward working surfaces of opposed double-disc counter-rotating abrasive media retaining pads. The apparatus of the present invention is particularly well suited and adapted for rapidly deburring metal workpieces of relatively thin cross-section, and for undertaking such an operation on a highly efficient and expeditious basis.

In the past, various techniques have been employed for the removal of burrs, sharp edges, or other protrusions from metal workpieces. Most commonly, deburring operations were undertaken by tumbling the metal workpieces in a revolving drum or barrel in which a quantity of abrasive particles were retained, with the particles being maintained in suspension with other solids, or in an aqueous or in liquid suspension. Accordingly, while such techniques have been found acceptable, the present arrangement provides an improved means for deburring workpieces by controlled passage of the workpiece through a plane defined by the interface between opposed double-disc counter-rotating abrasive media retaining pads.

In the past, recognized deburring operations, while reliable, were time consuming and thus regarded as an operation which tended to extend or enlarge production times. Indeed, unless substantial quantities of conventional tumbler drums were available, this single operation could, in certain instances, limit the capability of production capacity. Furthermore, when certain metallic objects were undergoing deburring operations, the amount of waste created may become substantial, particularly when considering disposal of the working materials, including entrained metallic particles. In accordance with the present invention, however, rapid and effective deburring operations are achieved without requiring the availability of substantial production facilities or areas.

SUMMARY OF THE INVENTION

In accordance with the present invention, an improved deburring apparatus is provided which utilizes a rotating turntable having a plurality of work receiving and guiding bores formed therein to carry and guide workpieces from an infeed station, along and through a work station, and to an outfeed station. The infeed and outfeed stations which straddle the working station, provide areas for introducing and discharging workpieces into and from the apparatus and system. In order to assist in guiding the workpieces through the work station, upper and lower workpiece support plates are provided adjacent opposed major surfaces of the turntable. The lower workpiece support plate extends generally from the infeed station to the outfeed station, with the upper support plate being generally shorter in its arcuate length, so as to provide access to the turntable bores at the infeed station and to guide the workpieces to the outfeed station Superimposed axially aligned window openings are provided in both upper and lower workpiece support plates, so as to delineate the work station and permit contact between the surfaces of the workpiece and the opposed rotating abrasive media retaining pads. In this arrangement, upper and lower abrasive media retaining pads are provided and arranged to move in counter-rotational directions about a substantially common vertical axis. The peripheral edges of the forward working surfaces of each of the pads is arranged in close running contact with the surfaces of the upper and lower workpiece support plates at and along the edges of the window opening formed in each of the support plates, thus delineating the work station. Accordingly, as the workpiece moves through the system guided by the motion of the turntable, the workpieces are carried into the work station where they are exposed to the abrasive surfaces of the upper and lower abrasive media retaining pads. Exposure of the workpieces to the forces created by the counter-rotational motion of the abrasive pads has been found to be an effective tool for burr removal. Following exposure to the counter-rotating abrasive pads, the workpieces continue along the path defined by the rotation of the turntable until the outfeed station is reached. At the outfeed station, the individual workpieces are removed from the system, normally by gravity drop. While most deburring operations can be undertaken with a constantly moving turntable, it will be appreciated that certain deburring operations may be better suited to an indexing turntable with intermittent periods of dwell being provided to modify or control the dwell or holding period for the workpiece within the work station.

Therefore, it is a primary object of the present invention to provide an improved deburring apparatus which is arranged to expose individual workpieces to the working surfaces of a pair of opposed counter-rotating abrasive media retaining pads.

It is a further object of the present invention to provide an improved deburring apparatus which employs a turntable for directing the motion of individual workpieces through a work station where the individual workpieces are subjected to the forces created by opposed double-disc and counter-rotating abrasive media retaining pads.

Other and further objects of the present invention will become apparent to those skilled in the art upon a study of the following specification, appended claims, and accompanying drawings.

IN THE DRAWINGS

Figure 1:
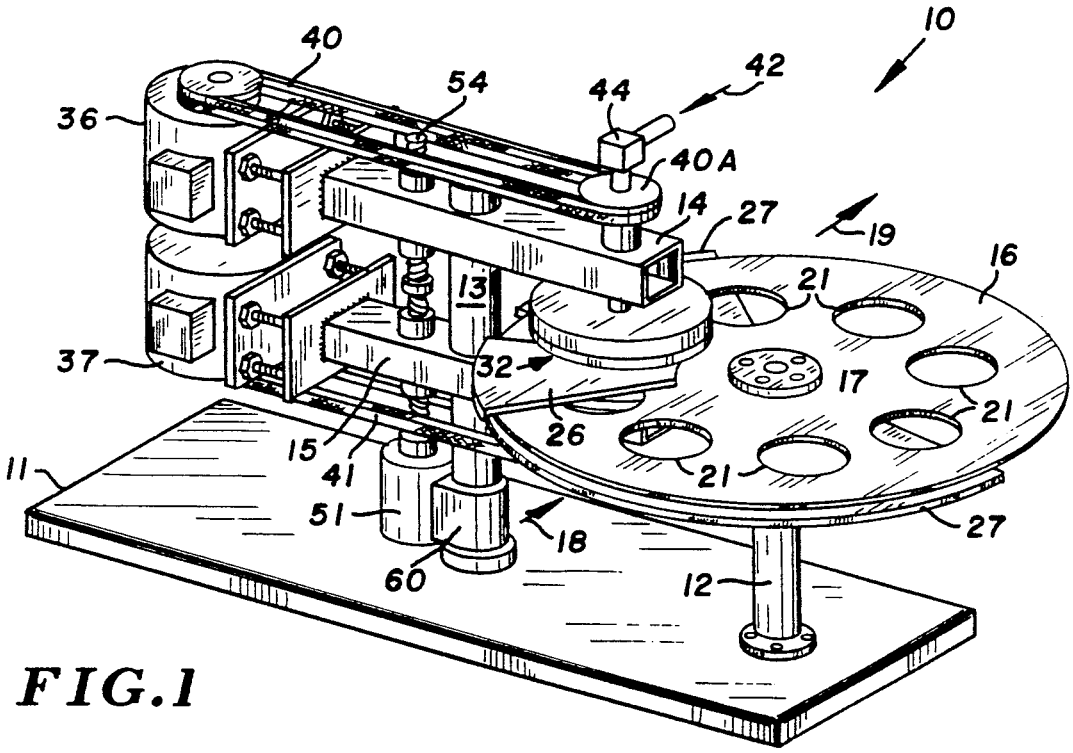
FIG. 1 is a perspective view illustrating one embodiment of an apparatus designed to accept, treat, and discharge workpieces in accordance with the various aspects of the present invention, with the workpiece guide means and rotating turntable being shown in somewhat spaced-apart relationship to better illustrate the details of the structure.
Figure 3:
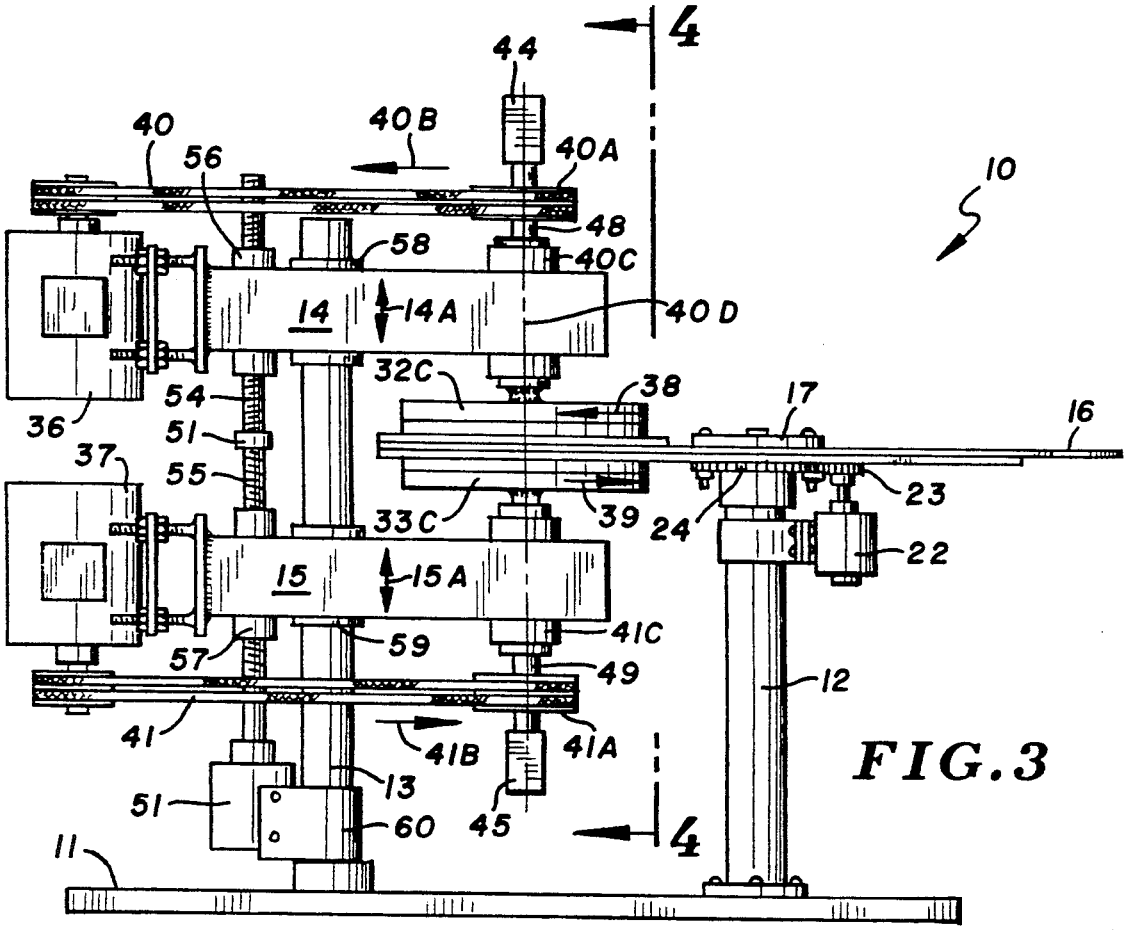
FIG. 3 is a side elevational view of the apparatus illustrated in FIG. 1.
Figure 4:
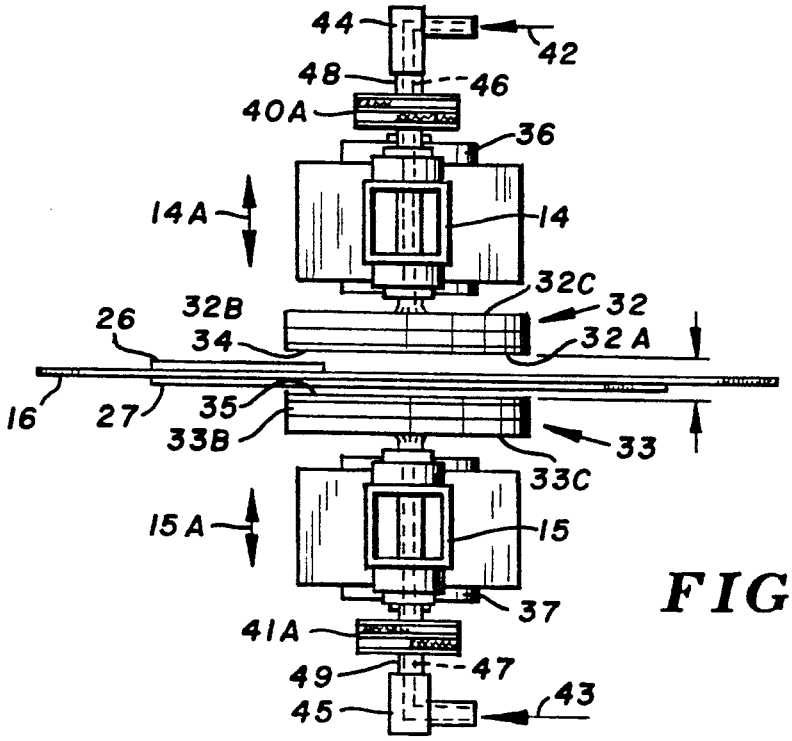
Figure 5:
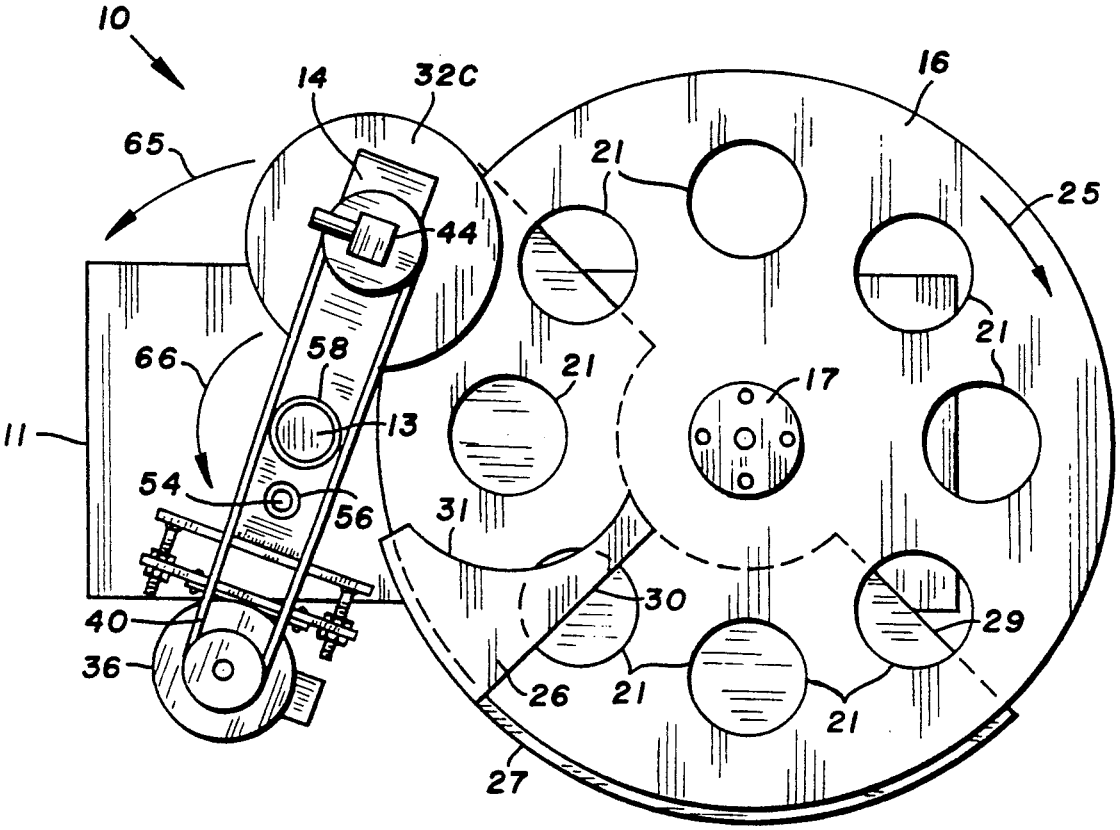

FIG. 4 is a vertical sectional view taken along the line and in the direction of the arrows 4—4 of FIG. 3, with the abrasive media retaining pads being shown in retracted disposition; and FIG. 5 is a top plan view of the apparatus illustrated in FIG. 1 and with a portion of the mechanism being shown in pivotally displaced disposition to a second position to facilitate and enable servicing of the abrasive discs.

DESCRIPTION OF THE PREFERRED EMBODIMENT

Figure 2:
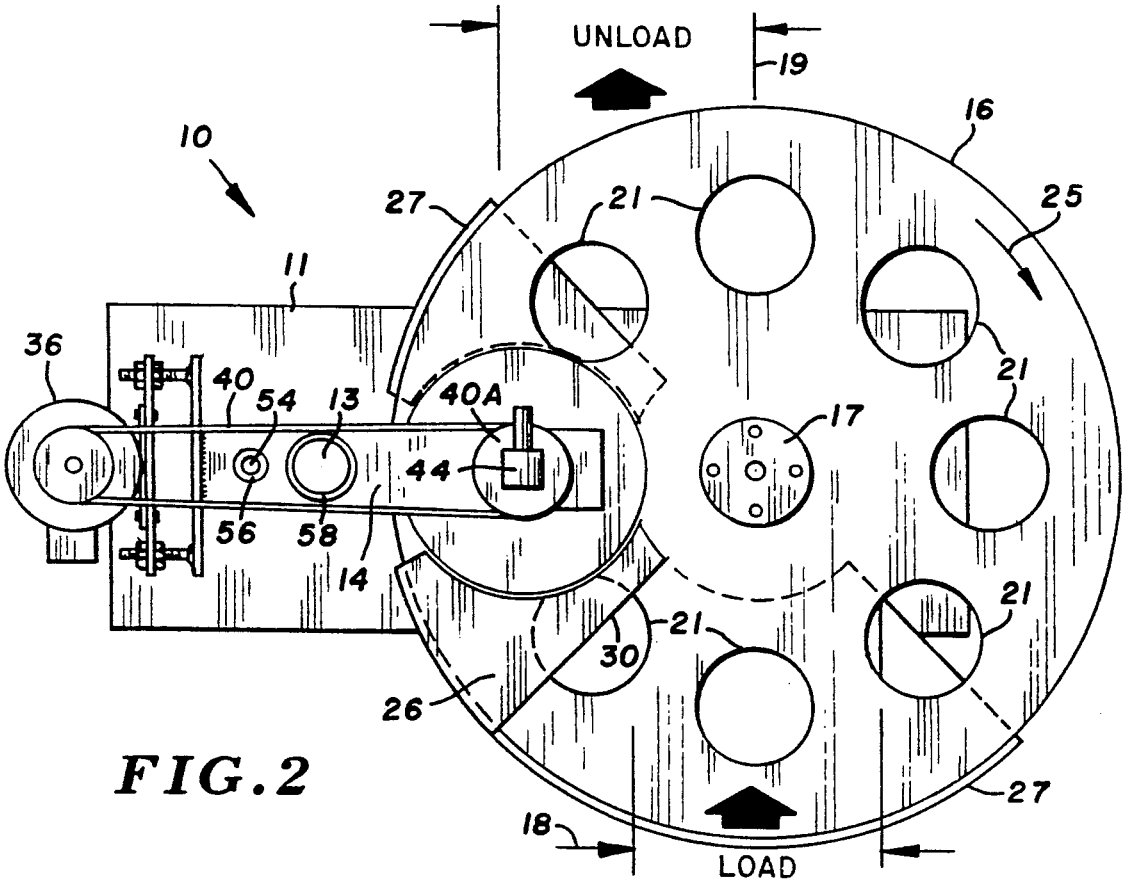
FIG. 2 is a top plan view of the apparatus illustrated in FIG. 1, and further designating the location of the load and unload stations of the apparatus.

With attention now being directed to FIGS. 1 and 2 of the drawings, it will be noted that the deburring apparatus generally designated 10 comprises frame means in the form of a base table or pad 11, a turntable support post 12, and a head and motor support column or post 13, along with upper and lower horizontal support arms 14 and 15 coupled to post 13. As is indicated in FIGS. 1 and 2, post 12 supports turntable 16 about bearing assembly 17, with bearing assembly 17 providing a journal means for accommodating rotation of turntable 16 about its central axis. Turntable 16 further has a defined or designated load station 18 and unload station 19 for handling of workpieces being treated within the apparatus 10.

A work station is provided in the apparatus, particularly as shown generally at 20. Work station 20 is arranged generally midway between load station 18 and unload station 19, being interposed along concentric windows or openings formed in the guide means as defined hereinafter. In order to carry workpieces into the work station 20, a plurality of work receiving and guiding bores 21—21 are formed in turntable 16, and accordingly function to carry and guide workpieces along an arcuate path from the infeed station through the work station, and ultimately onto the outfeed station. This motion is accomplished by continuous rotation of turntable 16 through turntable drive motor 22 and its output drive gear 23 meshing with turntable driven gear 24, with the direction of travel of turntable 16 being indicated by arrow 25 in FIG. 2. Alternatively, intermittent or indexed motion of turntable 16 may be utilized in order to modify or otherwise control the dwell time of workpieces within work station 20. The turntable 16 has a cross-sectional thickness which is slightly less than the cross-sectional thickness of the individual workpieces being treated. This permits appropriate contact between the workpiece and the abrasive surface.

Guide means in the form of upper and lower workpiece support plates are provided to work in combination and cooperation with turntable 16, with the upper workpiece support plate being shown at 26, and with the lower workpiece support plate being shown at 27. The arrangement and disposition of workpiece support plates 26 and 27 is shown in somewhat greater detail in FIG. 4. As indicated, support plates 26 and 27, which are stationary, have surface areas disposed adjacent selected portions of opposed major surfaces of the turntable, and provide support for workpieces traversing the arcuate path between the load station 18 and unload station 19, and also while entering into and leaving the work station 20. Except for the area of the window opening for the work station, lower support plate 27 extends for the entire distance between its leading edge 29 adjacent the load or infeed station and its trailing edge adjacent the unload or outfeed station. In certain instances, lower workpiece support plate 27 may comprise first and second individual segments, with the first segment extending from the load station to the inlet of the work station, and with the second segment extending from the output edge of the work station to the unload station. Upper workpiece support plate 26 is somewhat shorter in its arcuate dimension, and extends generally from a point downstream from the leading edge 29 of lower support plate 27, as at 30, to its downstream peripheral window opening at the work station, as at 31. Generally, the window openings formed in the support plates to delineate the work station are arranged along a common axis in superimposed relationship, one to another, and have a radius dimension sufficiently large to accommodate and enclose opposed upper and lower rotatable abrasive media retaining pads shown generally at 32 and 33 therewithin. In order to assist in guiding individual workpieces exiting the work station, the leading edge of the lower guide plate may be flared outwardly at its edge leading from work station 20 to aid in the guiding operation.

Turning now to the details of the embodiment as illustrated in FIGS. 3 and 4, upper and lower abrasive media retaining pads 32 and 33 each have a forward working surface, such as at 34 and 35 respectively, and are operatively coupled to drive means including individual motors 36 and 37. As indicated, motors 36 and 37 are arranged to drive abrasive media retaining pads 32 and 33 in opposed counter-rotational directions (see directional arrows 38 and 39) about a substantially common axis 40. The peripheral edges of the forward working surfaces 34 and 35 are arranged in closely spaced relationship with the periphery of work station 20, thereby permitting the workpieces being carried within the bores 21—21 to appropriately enter the work station and be exposed to working abrasive contact with the opposed abrasive media retaining pads 32 and 33 before leaving the work station.

For achieving rotation of abrasive pads 32 and 33, belt drive systems may be utilized, such as are shown at 40 and 41. A supply of liquid coolant is provided for abrasive pads 32 and 33 through a coolant supply conduit as shown somewhat schematically at 42 and 43. Thus, liquid coolant enters the system through swivel inlet ports 44 and 45, and is permitted to pass through the cores 46 and 47 of hollow shafts 48 and 49 respectively. Thus, coolant is passed from inlet ports 44 and 45 directly into abrasive media retaining pads 32 and 33, and appropriately onto each of the working surfaces thereof.

The abrasive media retaining pads are formed as a stacked arrangement, with the abrasive containing portions 32A and 32B having forward working abrasive surfaces 34 and 35 formed of a commerically available media such as, for example, that sold by the 3M Company of St. Paul, Minn. under the designation "Scotchbrite" abrasive media. The abrasive media is, in turn, retained on the inwardly adjacent pad with a conventional hook-and-loop system such as that type of system offered commerically under the trade designation "Velcro". For this type of application, one appropriate mounting system has been that offered commercially under the designation "Dual-Lok" from the same organization. The base pads 32B and 33B are each preferably in the form of an open cell foam pad having a thickness of between about one-quarter inch and one-half inch. These individual members are secured to generally rigid base pads as at 32C and 33C respectively through which the coolant is permitted to flow. The rigid base pad members may be fabricated from metal, such as aluminum, which is, in turn, bolted to the hollow drive shaft. Aluminum having a thickness of about one-eighth inch has been found suitable.

As indicated in FIG. 4, abrasive pads 32 and 33 are illustrated in partially retracted disposition. In order to achieve positioning of pads 32 and 33, vertical motion of support arms 14 and 15 is achieved in the direction of double-headed arrows 14A and 15A by actuation of stepper motor 51 and its shaft 52, with oppositely threaded segments 53 and 54 which mesh with right-hand or left-hand nuts (or threaded bushings) fast upon support arms 14 and 15. Positioning of upper and lower support arms 14 and 15 is accordingly achieved by controlled actuation of threaded shaft 52 and bushings 56 and 57 of stepper motor 51, with adjustment and control of disc or pad pressure being achieved this way as well. Slidable guide bushings are provided as at 58 and 59 to aid in controlling the disposition of support arms 14 and 15 along post or column 13. Thrust bearing 60 may be provided along post 13 in order to provide for appropriate system support. It will be seen, therefore, that motors 36 and 37 along with their belt systems 40 and 41 cause movement of the belts along the direction of arrows 40B and 41B, thus providing rotation of driven pulleys 40A and 41A. Appropriate bearings or other journals are provided within support arms 14 and 15 for hollow shafts 48 and 49 as at 40C and 41C respectively.

With particular attention now being directed to FIG. 5 of the drawings, upper and lower support arms 14 and 15 may be swung as a unit about the axis of support post or column 13, particularly in and along the direction of arrows 65 and 66. This motion permits access to and servicing of pads 32 and 33 whenever such servicing is indicated. A conventional form of centering means or locking means (not shown) is employed to retain the abrasive system carrying support arms 14 and 15 in their normal working disposition.

It will be appreciated that various changes may be made in the structure of the preferred embodiment of the apparatus described and illustrated herein without actually departing from the spirit and scope of the present invention. Therefore, the invention is to be measured in accordance with the scope of the following claims.

What is claimed is:

1. A deburring apparatus comprising frame means supporting the combination of:

(a) a workpiece infeed station, a workpiece outfeed station, and a work station therebetween comprising upper and lower rotatable abrasive media retaining pads;

(b) a turntable having a plurality of work receiving and guiding bores formed therein to carry workpieces along an arcuate path from said infeed station through said work station and to said outfeed station upon rotation of the turntable about the central axis thereof;

(c) guide means comprising upper and lower workpiece support plates having surface areas disposed adjacent selected portions of opposed major surfaces of said turntable and positioned along said arcuate path for capture of workpieces disposed within said turntable bores while being moved along portions of said arcuate path, with said lower workpiece support plate positioned below said turntable and extending along a first elongated arcuate segment generally from said infeed station through said work station to said outfeed station with a window opening formed therein defining a lower leading edge and delineating the lower peripheral surface of said work station, and with said upper workpiece support plate positioned above said turntable and extending along a second arcuate segment which is opposed to said first arcuate segment and extends from a leading edge disposed downstream of said infeed station to a generally acruately formed trailing edge disposed above and in substantially opposed relationship to the lower leading edge of said window opening;

(d) said upper and lower abrasive media retaining pads each having a forward working surface and being operatively coupled to drive means for rotation in counter-rotational directions about a substantially common axis, and with the peripheral edges of said forward working surfaces being arranged in closely spaced relationship with the peripheral edges of said window opening; wherein said work station is selectively arcuately rotatable between a securable first position where said work station engages said turntable and workpieces retained therein and a second arcuately spaced position where said work station is rotated away from both said turntable and said upper support plate such that said upper and lower abrasive pads are accessible for servicing; the arrangement being such that when workpieces carried within said work receiving and guiding bores enter said window opening, their surfaces are exposed simultaneously to the counter-rotational motion of said abrasive media retaining pads for deburring thereof.

2. The deburring apparatus as defined in claim 1 wherein each of said abrasive media retaining pads is coupled to a source of liquid coolant.

3. The deburring apparatus as defined in claim 2 wherein said liquid coolant is water.

4. The deburring apparatus as defined in claim 1 wherein said abrasive media retaining pads are retained on a base through hook-and-loop retaining members.

* * * * *